US010301138B2

(12) United States Patent
Ehret

(10) Patent No.: US 10,301,138 B2
(45) Date of Patent: May 28, 2019

(54) IMBRICATING METHOD, FOLDING METHOD, METHOD FOR PREPARING FOLDED BLANKS IN AN IMBRICATED STREAM, AND DEVICES CONFIGURED FOR THIS PURPOSE

(71) Applicant: Bernhard Ehret, Freiburg (DE)

(72) Inventor: Bernhard Ehret, Freiburg (DE)

( * ) Notice: Subject to any disclaimer, the term of this patent is extended or adjusted under 35 U.S.C. 154(b) by 0 days.

(21) Appl. No.: 15/791,879

(22) Filed: Oct. 24, 2017

(65) Prior Publication Data

US 2018/0111781 A1 Apr. 26, 2018

(30) Foreign Application Priority Data

Oct. 25, 2016 (DE) ..... 10 2016 012 712

(51) Int. Cl.

| | |
|---|---|
| ***B65H 37/06*** | (2006.01) |
| ***B65H 29/66*** | (2006.01) |
| ***B65H 29/52*** | (2006.01) |
| ***B65H 45/22*** | (2006.01) |
| ***B65H 45/28*** | (2006.01) |

(52) U.S. Cl.

CPC ..... *B65H 29/6681* (2013.01); *B65H 29/52* (2013.01); *B65H 29/6609* (2013.01); *B65H 29/6627* (2013.01); *B65H 37/06* (2013.01); *B65H 45/22* (2013.01); *B65H 45/28* (2013.01); *B65H 2301/4454* (2013.01); *B65H 2404/612* (2013.01); *B65H 2701/11231* (2013.01); *B65H 2701/1916* (2013.01)

(58) Field of Classification Search

CPC ..... B65H 29/6681; B65H 29/52; B65H 29/6609; B65H 29/6627; B65H 37/06; B65H 45/22; B65H 45/28

See application file for complete search history.

(56) References Cited

U.S. PATENT DOCUMENTS

| | | | | |
|---|---|---|---|---|
| 4,340,212 A * | 7/1982 | Simson | B41F 13/58 | 270/20.1 |
| 4,770,407 A * | 9/1988 | Nail | B65H 29/16 | 271/151 |
| 4,824,503 A * | 4/1989 | Wilen | B42C 19/06 | 156/204 |
| 6,341,773 B1 * | 1/2002 | Aprato | B65H 39/06 | 270/52.01 |
| 6,460,842 B1 * | 10/2002 | Koelle | B65H 29/242 | 270/52.09 |

(Continued)

*Primary Examiner* — Patrick H Mackey

(74) *Attorney, Agent, or Firm* — Volpe and Koenig, P.C.

(57) ABSTRACT

An improved imbricating method, folding method, and device for producing imbricated streams (3) which are produced from singulated and preferably folded blanks (2) is provided. The method includes taking imbricated bundles of blanks including of a number of overlapping blanks corresponding to the number of the individual streams formed by the blanks of a first individual stream being transported at a distance from one another along a transport surface through a compiling station. In the process, the blanks of the at least one remaining individual stream are first of all deflected vertically with respect to the transport surface by a deflecting device of the compiling station and are then guided in the direction of the first individual stream and are subsequently deposited with an offset onto the blanks of the first individual stream.

14 Claims, 2 Drawing Sheets

(56) References Cited

U.S. PATENT DOCUMENTS

| | | | | |
|---|---|---|---|---|
| 6,460,844 | B1 * | 10/2002 | Clifford | B65H 39/06 270/52.09 |
| 6,978,994 | B2 * | 12/2005 | Ingelsten | B65H 31/10 270/52.09 |
| 7,841,276 | B2 * | 11/2010 | Eckert | B41F 13/56 101/219 |
| 7,950,640 | B2 * | 5/2011 | Bolza-Schunemann | B41F 13/56 101/227 |
| 8,608,149 | B2 * | 12/2013 | Schuler Cossette | B41F 13/58 101/227 |
| 8,857,624 | B1 * | 10/2014 | Preston | G07B 17/00467 209/552 |

* cited by examiner

IMBRICATING METHOD, FOLDING METHOD, METHOD FOR PREPARING FOLDED BLANKS IN AN IMBRICATED STREAM, AND DEVICES CONFIGURED FOR THIS PURPOSE

INCORPORATION BY REFERENCE

The following documents are incorporated herein by reference as if fully set forth: German Patent Application No. 10 2016 012 712.0, filed Oct. 25, 2016.

BACKGROUND

The invention relates to an imbricating method for producing an imbricated (or shingled) stream from at least two individual streams of singulated, unconnected blanks obtained from a paper web, in particular mail items, such as postcards or preferably folded letters. Furthermore, the invention also relates to a folding method for preparing folded blanks, preferably folded mail items, for example folded letters, and to a method for preparing an imbricated stream consisting of folded blanks.

In addition to the methods described above, the invention furthermore relates to an imbricating device for preparing an imbricated stream from at least two individual streams of singulated, unconnected blanks obtained from a paper web, in particular mail items, such as postcards or preferably folded letters, to a folding device for producing folded blanks, preferably folded mail items, for example folded letters, from a paper web, and to a device for preparing folded blanks in an imbricated stream.

Methods and devices of this type are previously known in various embodiments from the prior art. For example, it is known to fold paper webs printed with individual blanks, for example letters, using what is referred to as buckle folding and then to singulate the folded blanks and then to prepare said blanks in an imbricated stream, in which the singulated blanks are stacked one above another so as to overlap one another, in order for them to be placed into envelopes and dispatched.

The previously defined methods and devices are used, for example, for the dispatch preparation of what is referred to as mass mailings. In the case of mass mailings of this type, it is expedient, for as cost-effective a dispatch as possible, to collate the singulated letter items with a consecutive zip code, the sequence of which must not be changed. To this end, it has proven particularly expedient to collate the letter items in an imbricated stream with a consecutive zip code for said letter items to be placed into envelopes and dispatched since this is more favorable for the dispatch in respect of the letter postage.

The methods and devices previously known from the prior art, in particular those which make recourse to what is referred to as buckle folding, have a comparatively low processing speed here. There is therefore the need to prepare methods and devices of the type mentioned at the beginning, with which the processed quantity of blanks per unit of time can be increased, i.e. with which the blanks can be processed more rapidly.

SUMMARY

It is therefore the object of the invention to provide methods and devices of the type mentioned at the beginning which have a greater processing speed in comparison to the methods and devices previously known from the prior art and therefore permit a greater quantity of processed blanks per unit of time.

In order to achieve this object, an imbricating method with one or more features of the invention is provided. In particular, an imbricating method is provided for producing an imbricated stream from at least two individual streams of singulated, unconnected blanks obtained from a paper web, in particular mail items, such as postcards or preferably folded letters, in which first of all imbricated bundles of blanks including of a number of overlapping blanks corresponding to the number of the individual streams are formed by the blanks of a first individual stream being transported at a distance from one another along a transport surface through a compiling station. In the process, the blanks of the at least one remaining individual stream are first of all deflected vertically with respect to the transport surface by a deflecting device of the compiling station and are then guided in the direction of the first individual stream and are subsequently deposited with an offset onto the blanks of the first individual stream. According to the invention, it is then provided that the imbricated bundles of blanks produced in this manner are deposited on one another with an offset with respect to one another in an imbricating station and are thus combined to form the imbricated stream.

A great advantage of the method according to the invention for producing the imbricated stream is that the method can proceed continuously and at a high speed.

In one embodiment of the method according to the invention, it can be provided that the blanks of the at least one remaining individual stream are deflected upward with respect to the transport surface or the transport plane of the first individual stream. In another embodiment, likewise according to the invention, of the imbricating method, it can also be provided to deflect the blanks of the at least one remaining individual stream downward with respect to the transport surface or transport plane of the first individual stream.

Furthermore, it is possible that the at least one remaining individual stream is supplied with its blanks along a respectively curved path of the deflecting device above or below the transport surface of the first individual stream to the blanks of the first individual stream.

In this manner, the blanks of the at least two individual streams, which blanks are optionally supplied next to one another at the supply station, can be supplied to a common depositing site or to a common supporting track and can be combined there in the imbricated bundles of blanks already previously described. That is to say, in other words, that an individual stream of imbricated bundles of blanks can be produced in this manner from at least two individual streams of singulated blanks.

In addition, it can be expedient if a distance between two consecutive blanks of the at least two individual streams is increased before formation of the bundles of blanks. This can take place, for example, by an increase in the conveying speed of the blanks of the at least two individual streams upon entry into the compiling station and/or within the compiling station. Two consecutive blanks of an individual stream can thereby be separated to such an extent from each other that a layering of blanks on one another, which is required for producing the bundles of blanks, from each of the individual streams present is possible. It can be stated here that, as the number of individual streams, which are to be compiled, of unconnected, singulated blanks increases, the distance between the individual blanks can also be expediently increased.

In order to be able to combine the singulated blanks of the at least two individual streams, which are to be compiled, reliably and with high accuracy in the compiling station and initially to form imbricated bundles of blanks, it can be advantageous if the conveying speeds of the blanks of the first individual stream and of the at least one remaining individual stream are or have been coordinated with each other in such a manner that the blanks of the individual streams are compiled with a certain offset to form the imbricated bundles of blanks.

Depending on how large the offset of the blanks from one another within an imbricated bundle of blanks is intended to be, it can also be advantageous for the conveying speeds of the blanks of the different individual streams to also be able to be adjusted depending on the lengths of the different transport paths which the blanks of the different individual streams have to cover until they are initially combined in the imbricated bundles of blanks.

The advantages of the method according to the invention can be particularly readily used if the blanks are mail items. Furthermore, it can be provided that the mail items have been or are provided with a consecutive zip code, in particular in a rising or falling sequence. This can take place, for example, before or else during the compilation of the individual streams of unconnected, singulated blanks. However, it is also possible to compile blanks, which are already provided with a zip code, in a predetermined sequence to form an imbricated stream with the aid of the method according to the invention.

The object defined at the beginning is also achieved by a folding method with one or more features of the invention. In particular, a folding method for preparing folded blanks, preferably folded mail items, for example folded letters, from a paper web, is accordingly provided, in which the paper web having at least two streams of blanks provided next to each other on the paper web is supplied to a longitudinal cutting station, and the at least two streams are separated from one another by longitudinal cutting and, as a result, individual streams of blanks initially still connected are produced. According to the invention, it is then provided to supply the at least two individual streams to a plow folding station and to fold the passing-through individual streams of blanks which are still connected. Subsequently, the individual streams folded in this manner are supplied to a transverse cutting station, the individual blanks of the individual streams are separated from one another and individual streams of unconnected, singulated blanks are formed.

By use of plow folding stations for folding the individual streams of blanks which are still connected, the folding can take place with a significantly higher speed in comparison to previously customarily used buckle folding devices, which enables the entire folding method to be more efficient.

It can be advantageous if the blanks are mail items, for example letters, which are or have been printed onto the paper web in transverse format, in particular in digital print. Within the context of the invention, onto the paper web in transverse format means here that longitudinal sides of the mail items are oriented transversely or at right angles with respect to the direction of longitudinal extent of the paper web. The presence of the blanks in transverse format promotes the folding of the individual streams of blanks, which are printed in transverse format, with the aid of a plow folding station since the blanks supplied to the plow folding station in transverse format on the respective individual stream are then present here in an optimum orientation to the plow folding station and to the conveying direction of the respective individual stream. It is thus possible to fold a very long "endless stream" of blanks, which are still connected and provided on the endless stream in a transverse format, continuously, at a constant conveying speed and without interruptions in the passage.

The blanks can have been or can be arranged here on the paper web with a consecutive zip code or can have been or can be provided with a consecutive zip code. In this connection, it is conceivable that the blanks have been or are arranged on the paper web and therefore also in the at least two streams, which are provided next to each other on the paper web, and have been or are provided with a zip code rising or falling in a certain pattern. In the case of use of two streams which are arranged next to each other on the paper web and are possibly intended to be transferred later into an imbricated stream with the aid of the imbricating method already described previously, it can be expedient if two consecutive zip codes are distributed to the two individual streams on the paper web. In the case of a rising zip code, it can then be provided that a first zip code has been or is provided on a first stream and a second, following zip code on the second stream and a third zip code following the second zip code again on the first stream, and so on.

With the aid of the compiling station already previously described within the scope of the previously described imbricating method, the continuous sequence of zip codes (falling or else rising) can then be present at the latest in the imbricated stream from the at least two individual streams of singulated, unconnected blanks obtained from the paper web.

In the case of the folding method, it can furthermore be provided that a first flank is in each case folded into each of the at least two individual streams of connected blanks. This can take place in a first plow folding device of the plow folding station. In a second plow folding device of the plow folding station, a second flank can then into each case be folded in each of the at least two individual streams of connected blanks. After the plow folding of the individual streams, the two folded flanks of each individual stream can then have been or can then be folded inward where said flanks overlap one another and cover a central segment of the respective individual stream.

The object defined at the beginning is also achieved by a method for preparing an imbricated stream of folded blanks with one or more features of the invention. In order to achieve the object, a method for preparing an imbricated stream of folded blanks is in particular provided, in which the blanks are folded by a folding method according to one or more features of the invention and are then compiled by an imbricating method according to one or more features of the invention to form an imbricated stream.

A method for preparing an imbricated stream of folded blanks is thus provided, which method is distinguished by its high processing speed, its high quantity of processed blanks per unit of time and by its associated efficiency.

To achieve the object defined at the beginning, an imbricating device is also provided for preparing an imbricated stream from at least two individual streams of singulated, unconnected blanks obtained from a paper web, with one or more features of the invention. In particular, an imbricating device is provided for preparing an imbricated stream from at least two individual streams of singulated, unconnected blanks obtained from a paper web, in particular mail items, such as postcards or preferably folded letters, which imbricating device has a compiling station and an imbricating station mounted downstream of the compiling station. The compiling station of the imbricating device according to the invention has a transporter for a first individual stream of the at least two individual streams, and, for each further individual stream, a deflecting device with a transfer device. According to the invention, it is provided that the blanks of the first individual stream can be supplied to the imbricating station mounted downstream at a defined distance from one another along a transport surface by the transporter. By use of the transfer device of the at least one deflecting device, the blanks of the at least one further individual stream are deflected vertically relative to the transport surface, are transferred in the direction of the first individual stream and are deposited with an offset onto the blanks of the first individual stream in order to form imbricated bundles of blanks. Furthermore, the bundles of blanks can be supplied by the transporter to the imbricating station in order to produce the imbricated stream. Consequently, the transporter is therefore configured to supply the bundles of blanks to the imbricating station in order to produce the imbricated stream.

It can be expedient if the at least one deflecting device has a curved profile. It can be provided here that the at least one deflecting device has a profile which is curved vertically with respect to the transport surface, preferably upward, and horizontally in the direction of a supporting zone of the first individual stream on the transport surface. It is thus possible to supply the singulated blanks of the at least one remaining individual stream to the blanks, which are supplied on the transport surface, of the first individual stream in order to produce the imbricated bundles of blanks.

The transporter and/or the at least one transfer device can in each case be designed here as a conveyor track. It is particularly expedient if conveying speeds of the blanks on the transporter and of the blanks on the at least one transfer device can be coordinated or have been coordinated with one another. It is particularly preferred here to keep a conveying speed of the at least one transfer device greater than a conveying speed of the transporter. It is thereby possible that the blanks which are supplied along the generally curved profile of the transfer device and which then have to cover a greater distance than the blanks of the first individual stream, which are supplied on the transporter, can be combined promptly and in accordance with their offset simultaneously with the respective blanks of the first individual stream to form imbricated bundles of blanks.

In order to be able to reliably carry out the production of the imbricated stream from the imbricated bundles of blanks in the imbricating station, it can be advantageous if a conveying speed of the bundles of blanks on the transporter during passage from the compiling station into the imbricating station is greater than a conveying speed of the bundles of blanks in the imbricating station. In other words, the imbricated bundles of blanks are braked during passage into the compiling station in order to permit the compiling of the imbricated bundles of blanks, which are transported consecutively into the imbricating station, to form a continuous imbricated stream. It is particularly preferable here if the conveying speed of the bundles of blanks during passage from the compiling station into the imbricating station and the conveying speed of the bundles of blanks in the imbricating station can be coordinated with each other in order to be able to produce different degrees of imbrication of the produced imbricated streams with different overlappings of the individual blanks in the imbricated stream.

The object mentioned at the beginning is also achieved with a folding device with one or more features of the invention. According thereto, a folding device is in particular provided for producing folded blanks, preferably folded mail items, for example folded letters, from a paper web, which folding device has a longitudinal cutting station, a transverse cutting station and a folding station arranged between the longitudinal cutting station and the transverse cutting station in the transport direction or conveying direction of the blanks. It is provided here according to the invention that the longitudinal cutting station is configured for separating at least two streams of blanks provided next to each other on the paper web into individual streams. For this purpose, the longitudinal cutting station can have, for example, at least one rotating knife which is oriented in a manner corresponding to the longitudinal extent of the at least two streams of blanks, which are to be separated from one another, on the paper web. Furthermore, the transverse cutting station is configured according to the invention for separating and singulating the blanks contained in the at least two individual streams, which are produced with the aid of the longitudinal cutting station, and for producing individual streams of unconnected, singulated blanks.

For this purpose, it is possible, for example, to separate the blanks contained in the individual streams from one another with the aid of a knife arranged on a rotating roller. An axis of rotation of the roller can be oriented here transversely with respect to the longitudinal extent and conveying direction of the individual streams. According to the invention, it is furthermore provided that the folding station is designed as what is referred to as a plow folding station, with which the at least two passing-through individual streams of connected blanks can be folded.

It can be expedient if the folding station has a first plow folding device for folding a first flank in each case of each of the at least two individual streams of connected blanks, and a second plow folding device, which is mounted downstream in the conveying direction of the individual streams, for folding a second flank in each case of the at least two individual strands of connected blanks. It is thereby possible with the aid of the folding station to first of all introduce a first flank into each of the at least two individual streams by folding and subsequently, with the aid of the second plow folding device of the folding station, to fold the second flank into the at least two individual streams.

The object defined at the beginning is furthermore achieved by a device for preparing folded blanks in an imbricated stream with a folding device having one or more features of the invention and with an imbricating device having one or more features of the invention. It is provided here that the folding device and the imbricating device are connected to each other in terms of conveying for the transfer of individual streams of singulated, folded blanks.

BRIEF DESCRIPTION OF THE DRAWINGS

An exemplary embodiment of the invention is described in more detail below with reference to the drawings, in which, in a partially highly schematized illustration.

DETAILED DESCRIPTION OF THE PREFERRED EMBODIMENTS

Figure 1:
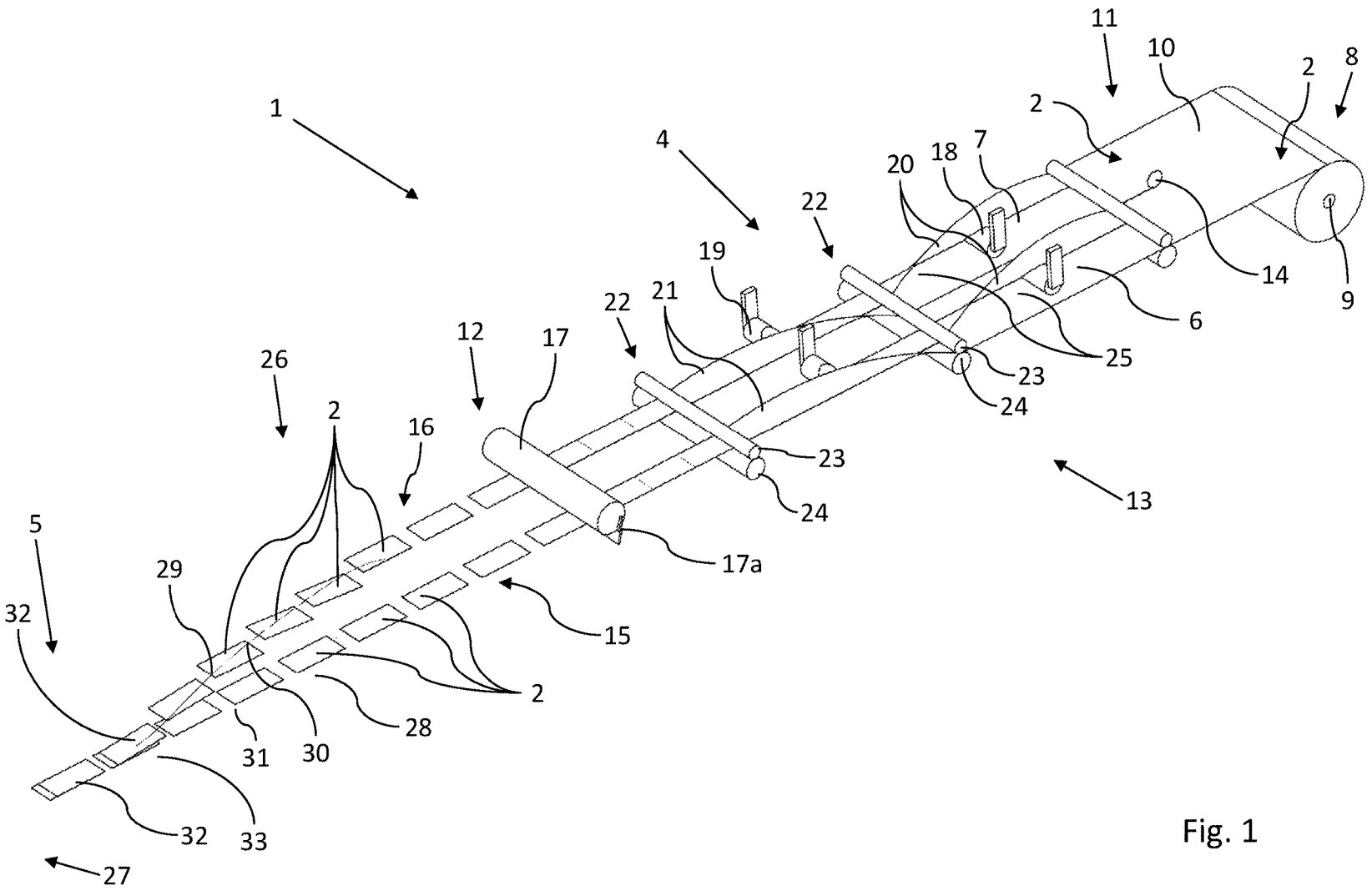
FIG. 1 shows a perspective view of a device for preparing folded blanks in an imbricated stream with a folding device and with an imbricating device arranged in a manner mounted downstream of the folding device, wherein it can be seen that the folding device and the imbricating device are connected to each other in terms of conveying.

FIG. 1 shows a device, which is denoted as a whole by 1, for preparing folded blanks 2 in an imbricated stream 3 with a folding device 4 and with an imbricating device 5.

The folding device 4 and the imbricating device 5 are connected to each other here in terms of conveying for the transfer of individual streams 6, 7 consisting of singulated, folded blanks 2. In FIG. 1, an unrolling station 8 with a roll 9, from which a paper web 10 is wound, can be seen mounted upstream of the folding device 4.

The folding device 4 is configured to produce the folded blanks 2 from the paper web 10. For this purpose, the paper web 10 is unrolled from the roll 9 of the unrolling station and supplied to the folding device 4.

The folding device 4 comprises a longitudinal cutting station 11, a transverse cutting station 12 and a folding station 13 arranged between the longitudinal cutting station 11 and the transverse cutting station 12.

From the roll 9 of the unrolling station 8, the paper web 10 is first of all supplied to the longitudinal cutting station 11. The longitudinal cutting station 11 has a knife 14 and is configured to sever two streams, which are provided next to each other, from the paper web 10, of blanks 2, which are still connected here, into the two individual streams 6 and 7.

The folding station 13 is designed as a plow folding station and is configured to fold the two passing-through individual streams 6 and 7 of blanks 2, which are still connected, during the passage of the individual streams 6 and 7 through the folding device 4.

The transverse cutting station 12 is arranged mounted downstream of the folding station 13. The transverse cutting station 12 is configured for separating and singulating the blanks 2 contained in the two individual streams 6 and 7 and for producing individual streams 15 and 16 of unconnected blanks 2.

For the separation and singulating of the blanks 2 contained in the two individual streams 6, 7, the transverse cutting station 12 has a transverse cutter 17 which is known from the prior art and comprises a knife 17*a* fastened to a rotatably mounted roll.

The folding station 13 comprises a first plow folding device 18 and a second plow folding device 19 which is mounted downstream in the conveying direction of the individual streams 6, 7. The first plow folding device 18 is configured for folding a first flank 20 in each case of each of the two individual streams 6, 7 of blanks 2 which are still connected here. The second plow folding device 19 which is mounted downstream is accordingly configured for folding a second flank 21 of the two individual streams 6, 7 of blanks 2 which are still connected here.

A pressing device 22 can be seen mounted downstream of the second plow folding device 19, the pressing device comprising two pressure rolls 23 and 24 arranged one above the other. The two folded individual streams 6, 7 are guided between said two pressure rolls 23 and 24 in order to press the two flanks 20 and 21 onto a central portion 25 of the respective individual streams 6, 7.

The imbricating device 5 is arranged mounted downstream of the folding device 4 in the conveying direction. The imbricating device 5 is configured for producing the imbricated stream 3 from the two individual streams 15 and 16 of singulated, unconnected blanks 2 obtained from the paper web 10.

In the present exemplary embodiment, said blanks 2 are mail items, namely folded letters.

The imbricating device 5 has a compiling station 26 and an imbricating station 27 which is mounted downstream of the compiling station 26 in the conveying direction.

Figure 2:
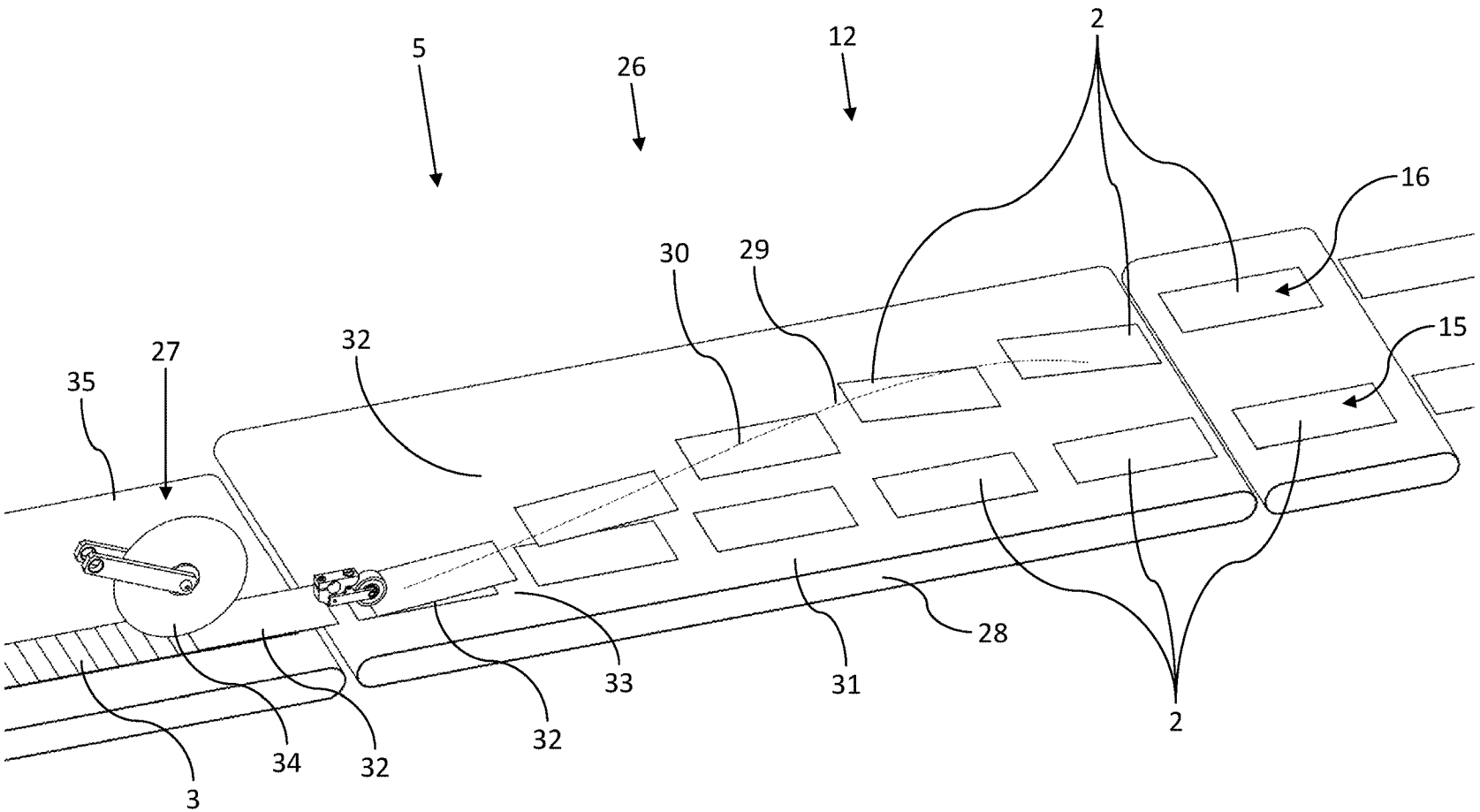
FIG. 2 shows a perspective view of an imbricating device according to the invention, wherein two individual streams of unconnected, singulated blanks are first of all combined with the aid of a compiling station of the imbricating device to form imbricated bundles of blanks and the imbricated bundles of blanks are then supplied to an imbricating station mounted downstream in order to produce the imbricated stream.

The compiling station 26, which is also illustrated in an enlarged illustration in FIG. 2, comprises a transporter 27, namely a conveyor belt, for a first individual stream 15 of the two individual streams 15 and 16, and a deflecting device 29 for the second individual stream 16 of the two individual streams 15 and 16. The deflecting device 29 comprises a transfer device 30.

The blanks of the first individual stream 15 can be supplied to the imbricating station 27 mounted downstream at a defined distance from one another along a transport surface 31 by the transporter 28.

By use of the transfer device 30 of the deflecting device 29, the blanks 2 of the second individual stream 16 are deflected vertically upward relative to the transport surface 31, are transferred in the direction of the first individual stream 15 and are deposited with an offset onto the blanks 2 of the first individual stream 15 in order to form imbricated bundles of blanks 32.

With the aid of the transporter 28, the imbricated bundles of blanks 32 are then supplied to the imbricating station 27 in order to produce the actual imbricated stream 3.

As already explained, the deflecting device 29 has a profile which is curved vertically upward with respect to the transport surface 31 and horizontally in the direction of a supporting zone 33 of the first individual stream 15 on the transport surface 31.

The transporter 28 and the transfer device 30 are each designed as a conveyor belt. Furthermore, the conveying speeds of the transporter 28, on the one hand, and of the transfer device 30, on the other hand, and therefore the conveying speed of the blanks 2 on the transporter 28 and of the blanks 2 on the transfer device 30 are coordinated with each other. This coordination is selected here in such a manner that the blanks 2 which are supplied via the transfer device 30 to the blanks 2 of the first individual stream 15 can be deposited on the blanks of the first individual stream 15. Since the blanks 2 have to cover a longer distance on their path via the transfer device 30 of the deflecting device 29 than the blanks which are conveyed via the transport surface 31 of the transporter 28, a conveying speed of the blanks 2 on the transfer device 30 is greater than a conveying speed of the blanks 2 on the transporter 28.

The conveying speed of the imbricated bundles of blanks 32 on the transporter 28 is greater, at least during the passage from the compiling station 26 into the imbricating station 27 mounted downstream, than a conveying speed of the bundles of blanks 32 in the imbricating station 27. The conveying speed of the bundles of blanks 32 during passage from the compiling station 26 into the imbricating station 27 and the conveying speed of the bundles of blanks 32 in the imbricating station 27 can be coordinated with each other here. This is done with the aim of being able to adjust the desired degree of imbrication of the imbricated stream 3.

The imbricating station 27 has a contact pressure roll 34 in a region facing the compiling station 26. The imbricated bundles of blanks 32 are conveyed toward said contact pressure roll 34 upon exit from the compiling station 26 and are braked, as a result of which the imbricated bundles of blanks 32 run onto one another and are combined to form the desired imbricated stream 3. Said imbricated stream 3 is conveyed further to the imbricating station by a conveyor belt 35.

The method described below for producing the imbricated stream 3 consisting of folded blanks 2 can be carried out on the device, which is denoted as a whole by 1, for preparing folded blanks 2 in the imbricated stream 3. The blanks 2 are first of all folded here by the folding method according to the invention and are then compiled by the imbricating method according to the invention to form the imbricated stream 3.

During the folding method, the paper web 10 with two streams of blanks 2 provided next to each other on the paper web 10 is first of all supplied to the longitudinal cutting station 11. In the longitudinal cutting station 11, the two streams are separated from each other by longitudinal cutting and individual streams 6, 7 of blanks 2 which are still connected are produced. The two individual streams 6, 7 produced in this manner are then supplied to the plow folding station 13 and folded. Subsequently, the folded individual streams 6, 7 pass into the transverse cutting station 12 where the individual blanks 2 of the individual streams 6, 7 are separated from each other and individual streams 15, 16 of unconnected, singulated blanks 2 are formed.

As already previously explained, the blanks 2 here are letters. The latter are printed onto the paper web 10 in transverse format, which can be undertaken, for example, in digital print. In transverse format means here that longitudinal sides of the blanks 2 are oriented transversely or at right angles with respect to the direction of longitudinal extent of the paper web 10.

The blanks 2 are provided on the paper web 10 with a consecutive zip code which is not separately illustrated in the figures. The consecutive zip code can be provided here, for example, in a certain pattern with a rising or falling profile.

In the first plow folding device 18 of the plow folding station 13, the first flank 20 is in each case folded in each of the two individual streams 15, 16 of blanks 2 which are still connected here. In the second plow folding device 19 which is mounted downstream of the plow folding device 18, the second flank 21 is in each case subsequently folded in each of the two individual streams 15, 16 of blanks 2 which are still connected.

By use of the pressing device 22 mounted downstream of the plow folding station 13 and the pressing device 22 arranged between the two plow folding devices 18 and 19 and the pressure rolls 23 and 24 which are in each case provided therein, the flanks 20 and 21 of each of the two individual streams 15 and 16 are then fixedly pressed onto a central portion 25 of the two individual streams 6 and 7.

After the folding, the imbrication takes place in order to produce the imbricated stream 3 from the two individual streams 15, 16 of singulated, unconnected blanks 2 obtained from the paper web 10.

The imbricated bundles of blanks 32 are first of all formed here from a number of overlapping blanks 2 corresponding to the number of individual streams 15, 16. This takes place by the blanks 2 of the first individual stream 15 being transported at a distance from one another along the transport surface 31 through the compiling station 26. The blanks 2 of the second individual stream 16 are first of all deflected vertically here with respect to the transport surface 31 by the deflecting device 29 of the compiling station 26 and are then transferred in the direction of the first individual stream 15. Having arrived there, they are deposited with an offset onto the blanks 2 of the first individual stream 15.

Subsequently, the imbricated bundles of blanks 32 produced in this manner are deposited on one another with an offset with respect to one another in the imbricating station 27 and are thus combined to form the imbricated stream 3.

The blanks of the second individual stream 16 are deflected upward here with respect to the transport surface 31 of the first individual stream 15. The second individual stream 16 is supplied with its blanks 2 to the blanks 2 of the first individual stream 15 along a curved path of the deflecting device 29 above the transport surface 31 of the first individual stream 15.

The distance between two consecutive blanks of the two individual streams 15, 16 is increased before formation of the bundles of blanks 32. This takes place by increasing the conveying speed of the blanks 2 upon entry into the compiling station 26.

The conveying speed of the blanks 2 of the first individual stream 15 and of the blanks 2 of the second individual stream 16 are coordinated with each other here in such a manner that the blanks 2 of the two individual streams 15 and 16 can be compiled with the desired offset from one another to form the imbricated bundles of blanks 32. In the imbricating station 27 which is mounted downstream, the imbricated bundles of blanks 32 produced in this manner are then combined to form the imbricated stream 3.

The invention is concerned with improvements in the field of producing imbricated streams 3 which are produced from singulated and preferably folded blanks 2. An imbricating method, a folding method and a method for preparing folded blanks 2 in an imbricated stream 3, and also devices 1, 4 and 5 which are configured for carrying out said methods and with which a greater number of blanks 2 can be processed per unit of time are thus provided.

LIST OF REFERENCE NUMBERS

1 Device
2 Blanks
3 Imbricated stream
4 Folding device
5 Imbricating device
6 Individual stream of connected blanks
7 Individual stream of connected blanks
8 Unrolling station
9 Roll
10 Paper web
11 Longitudinal cutting station
12 Transverse cutting station
13 Folding station
14 Knife at 11
15 Individual stream of unconnected blanks
16 Individual stream of unconnected blanks
17 Transverse cutter
17*a* Knife at transverse cutter
18 First plow folding device
19 Second plow folding device
20 First flank
21 Second flank
22 Pressing device
23 Pressure roll
24 Pressure roll
25 Central portion of 6, 7
26 Compiling station
27 Imbricating station
28 Transporter
29 Deflecting device
30 Transfer device

31 Transport surface
32 Imbricated bundle of blanks
33 Supporting zone
34 Contact pressure roll
35 Conveyor belt in 27

The invention claimed is:

1. An imbricating method for producing an imbricated stream (3) from at least two individual streams (15, 16) of singulated, unconnected blanks (2) which are obtained from a paper web (10), comprising first forming imbricated bundles of blanks (32) of a number of overlapping blanks (2) corresponding to a number of the individual streams (15, 16) by the blanks (2) of a first of the individual stream (15, 16) being transported at a distance from each other along a transport surface (31) through a compiling station (26), deflecting the blanks (2) of the at least one remaining one of the individual stream (15, 16) first vertically with respect to the transport surface (31) by a deflecting device (29) of the compiling station (26) and then transferring the blanks (2) of the at least one remaining one of the individual stream (15, 16) in a direction of the first individual stream (15, 16), and subsequently depositing the blanks (2) of the at least one remaining one of the individual stream (15, 16) with an offset onto the blanks (2) of the first individual stream (15, 16), and depositing the imbricated bundles of blanks (32) so produced on one another with an offset with respect to one another in an imbricating station (27) thus combining the imbricated bundles of blanks (32) to form the imbricated stream (3;

wherein a distance between two consecutive blanks (2) of the at least two individual streams (15, 16) is increased before formation of the bundles of blanks (32) by an increase in a conveying speed of the blanks (2) at least one of upon entry into the compiling station (26) or within the compiling station (26).

2. The method as claimed in claim 1, wherein the blanks (2) of the at least one remaining one of the individual streams (15, 16) are deflected upward or downward with respect to the transport surface (31) or transport plane of the first individual stream (15, 16), or the at least one remaining one of the individual streams (15, 16) is supplied with the blanks (2) along a respectively curved path of the deflecting device (29) above or below the transport surface (31) of the first individual stream (15, 16) to the blanks (2) of the first individual stream (15, 16), or both.

3. The method as claimed in claim 1, wherein the conveying speeds of the blanks (2) of the first individual stream (15, 16) and of the at least one remaining one of the individual streams (15, 16) are coordinated with each other such that the blanks (2) of the individual streams (15, 16) are compiled with the offset that is predetermined to form the imbricated bundles of blanks (32).

4. The method as claimed in claim 1, wherein the blanks (2) are mail items, or the blanks are mail items and the mail items have been or are provided with a consecutive zip codes, and the mail items with the consecutive zip codes are compiled in the imbricated stream (3).

5. A folding method for preparing folded blanks (2) from a paper web (10), comprising supplying the paper web (10) having at least two streams of blanks (2) provided next to each other on the paper web (10) to a longitudinal cutting station (11), and separating the at least two streams from one another by longitudinal cutting producing individual streams (6, 7) of blanks (2), supplying the at least two individual streams (6, 7) to a plow folding station (13) and folding the at least two individual streams, then supplying the individual streams (6, 7) to a transverse cutting station (12) and separating individual ones of the blanks (2) of the individual streams (6, 7) from one another, and then forming individual streams (15, 16) of unconnected, singulated blanks (2), wherein the folding further comprises in a first plow folding device (18) of the plow folding station (13), folding a first flank (20) in each case into each of the at least two individual streams (15, 16) of the connected blanks (2), and in a second plow folding device (19) of the plow folding station (13), folding a second flank (21) in each case into each of the at least two individual streams (15, 16) of the connected blanks (2).

6. The method as claimed in claim 5, wherein the blanks (2) are mail items that are printed or have been printed onto the paper web (10) in transverse format, and longitudinal sides of the blanks (2) are oriented transversely or at right angles with respect to a direction of a longitudinal extent of the paper web (10).

7. The method as claimed in claim 5, wherein the blanks (2) have been or are arranged on the paper web (10) with consecutive zip codes.

8. A method for producing an imbricated stream (3) of folded blanks (2), comprising providing the folded blanks (2) from a paper web (10) by supplying the paper web (10) having at least two streams of blanks (2) provided next to each other on the paper web (10) to a longitudinal cutting station (11), and separating the at least two streams from one another by longitudinal cutting producing individual streams (6, 7) of blanks (2), supplying the at least two individual streams (6, 7) to a plow folding station (13) and folding the at least two individual streams, then supplying the individual streams (6, 7) to a transverse cutting station (12) and separating individual ones of the blanks (2) of the individual streams (6, 7) from one another, and then forming individual streams (15, 16) of unconnected, singulated blanks (2), and then compiling the folded blanks by first forming imbricated bundles of the folded blanks (32) of a number of overlapping ones of the folded blanks (2) corresponding to a number of the individual streams (15, 16) by the folded blanks (2) of a first of the individual stream (15, 16) being transported at a distance from each other along a transport surface (31) through a compiling station (26), deflecting the folded blanks (2) of the at least one remaining one of the individual stream (15, 16) first vertically with respect to the transport surface (31) by a deflecting device (29) of the compiling station (26) and then transferring the folded blanks (2) of the at least one remaining one of the individual stream (15, 16) in a direction of the first individual stream (15, 16), and subsequently depositing the folded blanks (2) of the at least one remaining one of the individual stream (15, 16) with an offset onto the folded blanks (2) of the first individual stream (15, 16), and depositing the imbricated bundles of folded blanks (32) so produced on one another with an offset with respect to one another in an imbricating station (27) thus combining the imbricated bundles of blanks (32) to form the imbricated stream (3).

9. An imbricating device (5) for preparing an imbricated stream (3) from at least two individual streams (15, 16) of singulated, unconnected blanks (2) obtained from a paper web (10), the device (5) comprising a compiling station (26) and an imbricating station (27) mounted downstream of the compiling station (26), the compiling station (26) including a transporter (28) for a first of the at least two individual streams (15, 16) and, for each further one of the individual streams (16), a deflecting device (29) with a transfer device (30), wherein the blanks (2) of the first individual stream (15, 16) are supplied at a defined distance from one another along a transport surface (31) by the transporter (28) to the imbricating station (27) mounted downstream, wherein, the transfer device (30) of the at least one deflecting device (29) is adapted to deflect the blanks (2) of the at least one further individual stream (15, 16) vertically relative to the transport surface (31) and transfer the blanks in a direction of the first individual stream (15, 16) so that the blanks of the at least one further individual stream (15, 16) are adapted to be deposited with an offset onto the blanks (2) of the first individual stream in order to form imbricated bundles of blanks (32), wherein the transporter (28) is adapted to supply the bundles of blanks (32) to the imbricating station (27) in order to produce the imbricated stream (3), and conveying speeds of the blanks (2) on the transporter (28) and of the blanks (2) on the at least one transfer device (30) are coordinated with each other such that the conveying speed of the at least one transfer device (30) is greater than a conveying speed of the transporter (28).

10. The device (5) as claimed in claim 9, wherein the at least one deflecting device (29) has a profile which is curved vertically with respect to the transport surface (31), and horizontally in a direction of a supporting zone (33) of the first individual stream (15, 16) on the transport surface (31).

11. The device (5) as claimed in claim 9, wherein at least one of the transporter (28) or the at least one transfer device (30) comprise a conveyor belt.

12. The device (5) as claimed in claim 9, wherein the transporter (28) is configured such that a conveying speed of the bundles of blanks (32) on the transporter (28) during passage from the compiling station (26) into the imbricating station (27) is greater than a conveying speed of the bundles of blanks (32) in the imbricating station (27).

13. A folding device (4) for producing folded blanks (2) from a paper web (10), the folding device comprising a longitudinal cutting station (11), a transverse cutting station (12), and with a folding station (13) arranged between the longitudinal cutting station (11) and the transverse cutting station (12), the longitudinal cutting station (11) is configured for separating at least two streams of blanks (2) provided next to each other on the paper web (10) into individual streams (6, 7), the transverse cutting station (12) is configured for separating and singulating the blanks (2) contained in the at least two individual streams (6, 7) and for producing individual streams (15, 16) of unconnected, singulated blanks (2), and the folding station (13) comprises a plow folding station configured to fold the at least two passing-through individual streams (6, 7) of connected blanks (2), the plow folding station including a first plow folding device (18) that is adapted to fold a first flank (20) in each case of each of the at least two individual streams (6, 7) of the connected blanks (2), and a second plow folding device (19) mounted downstream in a conveying direction of the individual streams (6, 7), that is adapted to fold a second flank (21) in each case of the at least two individual streams (6, 7) of the connected blanks (2).

14. A device (1) for preparing folded blanks (2) in an imbricated stream (3) comprising:

a folding device (4) for producing folded blanks (2) from a paper web (10), the folding device comprising:

a longitudinal cutting station (11), a transverse cutting station (12), and a folding station (13) arranged between the longitudinal cutting station (11) and the transverse cutting station (12), the longitudinal cutting station (11) is configured for separating at least two streams of blanks (2) provided next to each other on the paper web (10) into individual streams (6, 7), the transverse cutting station (12) is configured for separating and singulating the blanks (2) contained in the at least two individual streams (6, 7) and for producing individual streams (15, 16) of unconnected, singulated blanks (2), and the folding station (13) comprises a plow folding station configured to fold the at least two passing-through individual streams (6, 7) of connected blanks (2)

an imbricating device (5) comprising a compiling station (26) and an imbricating station (27) mounted downstream of the compiling station (26), the compiling station (26) including a transporter (28) for a first of the at least two individual streams (15, 16) and, for each further one of the individual streams (16), a deflecting device (29) with a transfer device (30), wherein the blanks (2) of the first individual stream (15, 16) are supplied at a defined distance from one another along a transport surface (31) by the transporter (28) to the imbricating station (27) mounted downstream, wherein, the transfer device (30) of the at least one deflecting device (29) is adapted to deflect the blanks (2) of the at least one further individual stream (15, 16) vertically relative to the transport surface (31) and transfer the blanks in a direction of the first individual stream (15, 16) so that the blanks of the at least one further individual stream (15, 16) are adapted to be deposited with an offset onto the blanks (2) of the first individual stream in order to form imbricated bundles of blanks (32), and the transporter (28) is adapted to supply the bundles of blanks (32) to the imbricating station (27) in order to produce the imbricated stream (3), wherein the folding device (4) and the imbricating device (5) are connected to each other in terms of conveying for transfer of the individual streams (6, 7) of singulated, folded blanks (2).

* * * * *